US011135130B2

(12) United States Patent
Johnson

(10) Patent No.: US 11,135,130 B2
(45) Date of Patent: Oct. 5, 2021

(54) SYSTEM AND METHOD FOR SEXUAL STIMULATION

(71) Applicant: Mya Johnson, Atlantis, FL (US)

(72) Inventor: Mya Johnson, Atlantis, FL (US)

( * ) Notice: Subject to any disclaimer, the term of this patent is extended or adjusted under 35 U.S.C. 154(b) by 256 days.

(21) Appl. No.: 16/531,157

(22) Filed: Aug. 5, 2019

(65) Prior Publication Data

US 2021/0038471 A1 Feb. 11, 2021

(51) Int. Cl.
*A61H 19/00* (2006.01)

(52) U.S. Cl.
CPC ..... *A61H 19/44* (2013.01); *A61H 2201/0165* (2013.01); *A61H 2201/0188* (2013.01); *A61H 2201/0207* (2013.01); *A61H 2201/501* (2013.01); *A61H 2201/5048* (2013.01); *A61H 2201/5097* (2013.01)

(58) Field of Classification Search
CPC ..... A61H 19/00; A61H 19/30; A61H 19/34; A61H 19/40; A61H 19/44; A61H 19/50; A61H 21/00
See application file for complete search history.

(56) References Cited

U.S. PATENT DOCUMENTS

| | | | | |
|---|---|---|---|---|
| 9,649,249 | B1 * | 5/2017 | Green | A61H 19/32 |
| 2004/0082831 | A1 * | 4/2004 | Kobashikawa | A61H 19/44 600/38 |
| 2008/0306417 | A1 * | 12/2008 | Imboden | A61H 19/00 601/134 |
| 2018/0042809 | A1 * | 2/2018 | Zipper | A61H 23/0263 |

* cited by examiner

*Primary Examiner* — John P Lacyk
(74) *Attorney, Agent, or Firm* — Derek Fahey; The Plus IP Firm

(57) ABSTRACT

A system for sexual stimulation is disclosed. The system includes an elongated shaped assembly comprising a user interface, a charging port, a heating element, at least one light emitting element, a vibrating element, and a speaker configured to emit sound and vibration to the elongated shaped assembly. The system also includes a processor that is configured for receiving, from a remote computing device of a user, a first signal for controlling at least one of sound and vibrations to emanate from the speaker, light to emanate from the at least one light emitting element, and heat to emanate from the heating element. The processor is also configured for sending at least one second signal to cause at least one of sound and vibrations to emanate from the speaker, light to emanate from the at least one light emitting element, and heat to emit from the heating element.

18 Claims, 7 Drawing Sheets

SYSTEM AND METHOD FOR SEXUAL STIMULATION

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of adult sex toys, and more specifically to the field of sexual stimulation devices.

BACKGROUND

As methods for communicating have evolved and our everyday lives and work practices have gone global, more and more couples engage in what can be described as long-distance relationships. Long distance couples, such as dating college students, and those who are geographically-separated because of situational demands, often face challenges in maintaining some semblance of intimacy given the physical distance between them. The lack of interaction with a significant other in a long-distance relationship poses a hurdle for the sustainability of a healthy relationship.

Part of fostering a feeling of connection between long distance couples has been to communicate via traditional media such as telephones, emails, text messages, and webcams. A webcam is a video camera that feeds or streams its image in real time to or through a computer to a computer network. By incorporating video communication applications into their everyday lives, long distance couples seek to feel a sense of involvement and presence from their remote partner.

For couples in long distance relationships, an aspect of their relationship that has been broadened by the use of video communication is cybersex, in which the couples engage in activities ranging from kissing to masturbation. When engaging in cybersex, sex toys play a significant role. One of the most common sex toys used is a vibrator. A vibrator, sometimes described as a massager, is used on the body to produce pleasurable sexual stimulation. However, one of the challenges that are present for couples in long distance relationships is that the majority of vibrators available lack the ability to truly give a feeling of physical connection between partners. Moreover, many couples in long distance relationships hesitate to indulge in sex acts either from awkwardness or fear of security breaches when broadcasting their private sex videos. As a result, the lack of physical connection gives rise to a social issue in which couples in long distance relationships feel awkward or embarrassed about engaging in intimate activities.

Therefore, a need exists to improve over the prior art and more particularly, for a system that affords a unique opportunity for couples to experience intimate and physical sensations in response to actions taken by a long-distance partner.

SUMMARY

A system and method for sexual stimulation is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for sexual stimulation is disclosed. The system includes an elongated shaped assembly defining a shaft having forward end, a rearward end, an upward facing side and a downward facing side. A heating element is attached on the upward facing side on the forward end of the elongated shaped assembly. At least one light emitting element is attached with the elongated shaped assembly and configured to emit light from the elongated shaped assembly. A vibrating element is housed by the elongated shaped assembly and is configured for providing a vibrating sensation along the body of the elongated shaped assembly. A speaker is positioned within the elongated shaped assembly and configured to emit sound and vibration to the elongated shaped assembly. A user interface is configured for controlling at least the heating element and at least the one light emitting element. A charging port is positioned on the rearward end of the elongated shaped assembly.

The system also includes a processor housed within the elongated shaped assembly. The processor is configured for receiving, from a remote computing device of a user, a first signal for controlling at least one of sound and vibrations to emanate from the speaker, light to emanate from the at least one light emitting element, and heat to emanate from the heating element. The processor is also configured for sending at least one second signal to cause at least one of sound and vibrations to emanate from the speaker, light to emanate from the at least one light emitting element and heat to emit from the heating element.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
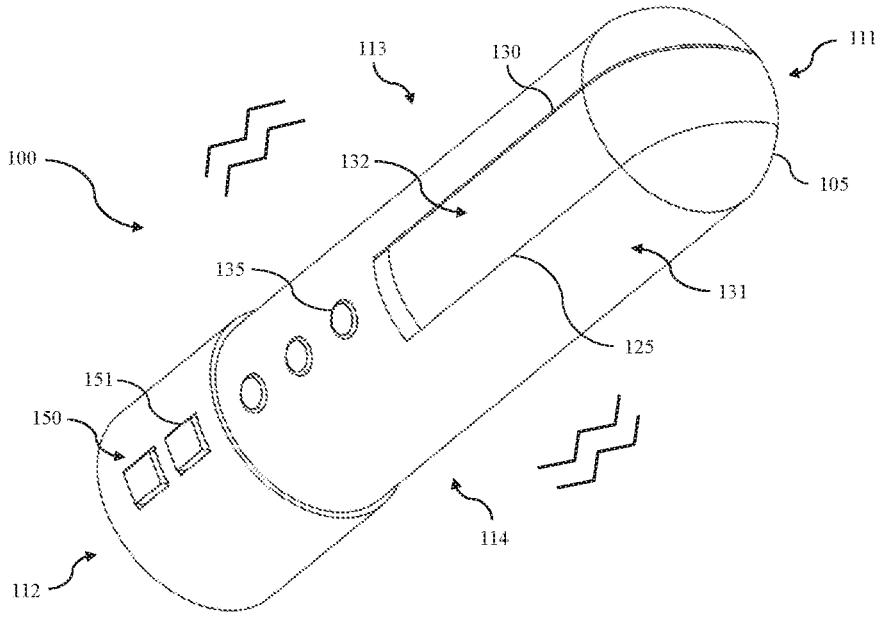
FIG. 1 is a perspective side view of a system for sexual stimulation, according to an example embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The present invention improves upon the prior art by providing a system and method for sexual stimulation. The present invention improves upon the prior art by incorporating a speaker positioned within an elongated shaped assembly. Research suggests that by listening to the right type of sound or music, one can stimulate their pleasure senses, and bond intimately with a partner—paving the way for potential heightened arousal. Therefore, the speaker of the present invention is configured to emit sound and vibration within the elongated shaped assembly as an effective vehicle to heightening sexual arousal and feelings of pleasure.

The present invention also improves upon the prior art by providing a system that allows a user to experience intimate and physical sensations in response to actions taken remotely by a long-distance partner. The system includes a processor housed within the elongated shaped assembly that is configured for receiving, from a remote computing device of a user, a first signal for controlling sound and vibrations to emanate from a speaker, light to emanate from at least one light emitting element, and heat to emanate from a heating element. The processor is also configured for sending at least one second signal to cause at least one of sound and vibrations to emanate from the speaker, light to emanate from the at least one light emitting element, and heat to emit from the heating element.

Referring now to the Figures, FIGS. 1-4 will be discussed together for ease of reference. The system 100 includes an elongated shaped assembly 105 defining a shaft having forward end 111, a rearward end 112, an upward facing side 113 and a downward facing side 114. In the present embodiment, the forward end of the elongated shaped assembly has a rounded dome-like shape, and the rearward end of the of the elongated shaped assembly has a substantially planar surface. The upward facing side and the downward facing side of the elongated shaped assembly extend upwardly from the rearward end to the forward end of the elongated shaped assembly, defining the cylindrical shape of the shaft. The elongated shaped assembly further includes an internal cavity which is cylindrical, preferably of circular cross-section.

As described herein, the elongated shaped assembly is generally sized to facilitate intimate contact with the human body so as to impart a massaging sensation thereto, however, it should be appreciated that the elongated shaped assembly can have other shapes and dimensions, and such variations are within the spirit and scope of the claimed invention. The elongated shaped assembly may be comprised of porous materials, such as plastic, or non-porous materials, such as metal, plastic, stone, and wood. Additionally, the exterior surface of the elongated shaped assembly is preferably food-safe, body-safe, hygienic, and cleanable with minimal internal or concave surfaces that can trap or hold dirt, bacteria, or fluid.

Figure 2:
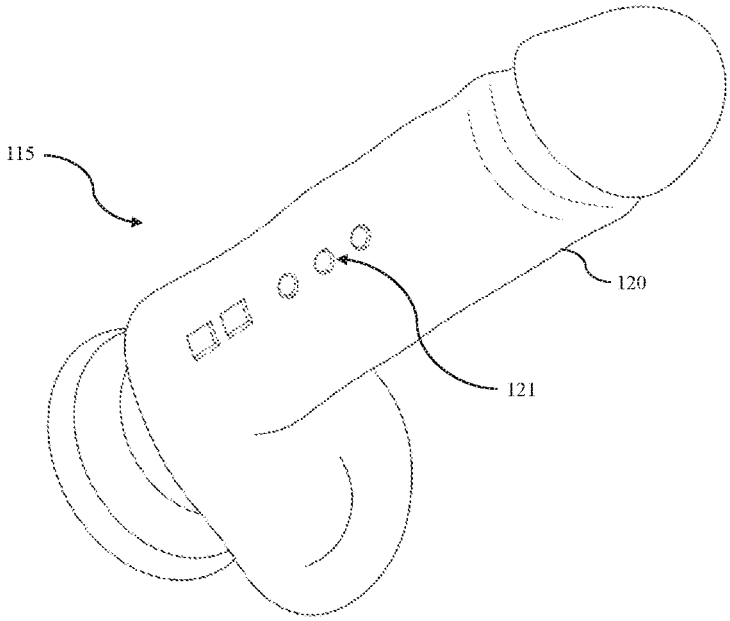
FIG. 2 is a perspective side view of a system for sexual stimulation covered by a silicone defining a penis shape, according to an example embodiment of the present invention.

As best shown in FIG. 2, the elongated shaped assembly is covered by a silicone 115 defining a penis shape 120. The silicone is configured to provide one continuous skin-like surface that is smooth and soft. The silicone also increases the durability and general life span of the elongated shaped assembly. In the present embodiment, the silicone consists of a hollow cylindrical shaped body having the form of an erect penis and is configured to be slid over the forward end of the elongated shaped assembly. The silicone contains a plurality of openings 121 (five are shown) to allow at least one light emitting element and a user interface (further identified below) located on the elongated shaped assembly to remain uncovered and therefore functional. It should be appreciated that the silicone may be interchanged and may take additional forms, textures, ridges, and dimensions, and such variations are within the spirit and scope of the claimed invention. The silicone may also be comprised of materials that emulate the feel of real skin as much as possible, such as jelly, cyberskin, futurotic, softskin, or other soft-touch materials.

A heating element 125 is attached with the upward facing side on the forward end of the elongated shaped assembly. The heating element provides a warming effect along the body of the elongated shaped assembly to increase blood flow, circulation, and sensitivity in the genital area. The heating element is conductively and communicatively coupled with a central processing unit and a power source (further identified below). In the present embodiment, the heating element is positioned inside a groove 130 along an outward facing surface of the elongated shaped assembly 131 such that an outward facing surface of heating element 132 is flush with the outward facing surface of the elongated shaped assembly. The heating element may include a plurality of heating wires or coils which run throughout the internal cavity of the elongated shaped assembly to heat the elongated shaped assembly. Additionally, the heating element may have more intense heating sections concentrated around the forward end of the elongated shaped assembly to provide additional pleasure and sensation.

The system also includes at least one light emitting element 135 attached with the elongated shaped assembly and configured to emit light from the elongated shaped assembly. The at least one light emitting element is configured to light up when the elongated shaped assembly is in use and may also include a timer that would periodically pulse light such that it is easy to find in the dark for retrieval and reuse. In the present embodiment, the at least one light emitting element is conductively and communicatively coupled with the central processing unit and power source (further identified below) and configured such that light is emitted from the upward side of the elongated shaped assembly. The at least one light emitting element is capable of emitting light of more than one color. Exemplary color-changing lights are RGB LEDs, bi-color LEDs, flashing LEDs, digital RGB LEDs, (organic) OLEDs, and RGB WLEDs (White LEDs).

A vibrating element 140 is housed by the elongated shaped assembly and configured for providing a vibrating sensation along the body of the elongated shaped assembly. The vibrating element is also configured to provide oscillating, rotating, pulsating, or sweeping motion. The vibrating element is conductively and communicatively coupled with the central processing unit and power source (further identified below). The vibrating element may be comprised of a small battery-operated motor, such as a solenoid actuator, a piezoelectric actuator, or any other suitable mechanisms known in the art.

Figure 3:
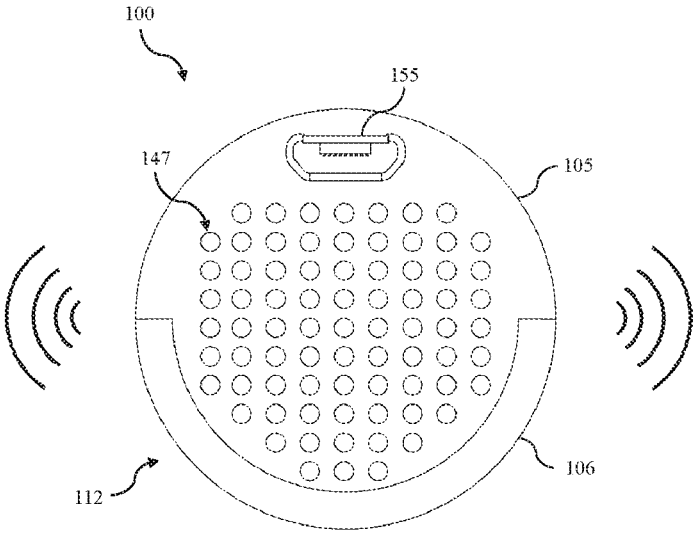
FIG. 3 is an end view of a system for sexual stimulation, according to an example embodiment of the present invention.
Figure 4:
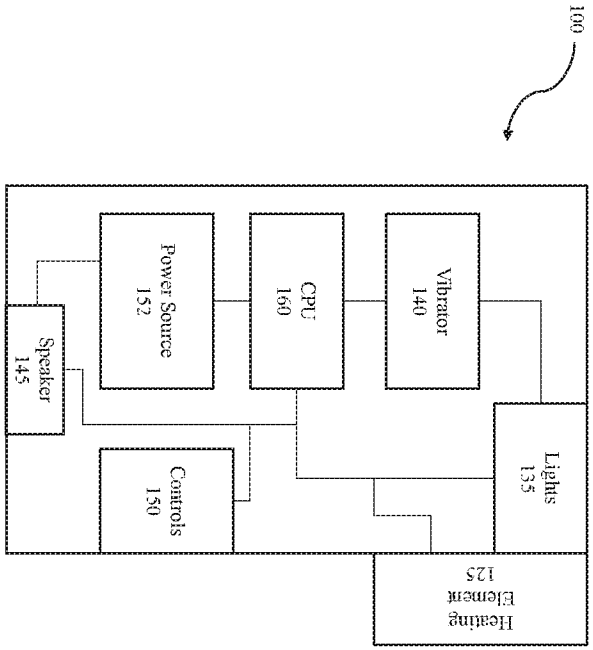
FIG. 4 is a block diagram showing the main components of a system for sexual stimulation, according to an example embodiment of the present invention.

As best shown in FIG. 3, a speaker 145 is positioned within the elongated shaped assembly and configured to emit sound and vibration throughout the elongated shaped assembly. In the present embodiment, the speakers emit sound from the rearward end of the elongated shaped housing. The speaker is configured to produce various sound channels, for example, low frequency, into corresponding physical vibrations. The physical vibrations from the sound waves stimulate the surface of highly-sensitive erogenous zones and adds a new dimension to a user's sexual experience. In addition to emitting sound and vibration throughout the body of the elongated shaped assembly, the speaker is also capable of broadcasting the voice of a remote user. The speaker is protected by a cover 146 having a plurality of openings 147. The openings are preferably a plurality of circular openings, but may also be louvers, a single large opening or other means for allowing sound to transmit through the cover from the speaker.

The system also includes a user interface 150 for controlling at least the heating element and the at least one light emitting element. In the present embodiment, the user interface is positioned along the outward facing surface of the elongated shaped assembly such that the outward facing surface of the user interface is flush with the outward facing surface of the elongated shaped assembly. The user interface comprises at least one button 151 that is in electoral communication with the processor. The at least one button (two are shown) can be depressed or pushed a predetermined number of times to control the functionality of the elongated shaped assembly, including the intensity from the heating element, the light color, color-change sequence, color selection, color-change transition effects (fast fade, slow fade, etc.), color-change duration or speed, and flashing or strobe effects of the at least one light emitting element, and the speed and motion of the vibrating element.

As best shown in FIG. 3, a charging port 155 is positioned on the rearward end of the elongated shaped assembly. The charging port is configured to connect to a power source 152, such as a long-lasting quick to charge lithium-ion battery, housed within the elongated shaped assembly. In one embodiment, the elongated shaped assembly can indicate its battery level (e.g. fully discharged, low, medium, high, or fully charged) by flashing the at least one light emitting element in various colors or patterns. Other types of rechargeable batteries, such as nickel metal hydride (NiMH) or multiple batteries and/or battery types could be used in the elongated shaped assembly, with the charging functionality then optimized for those battery configurations.

Figure 5:
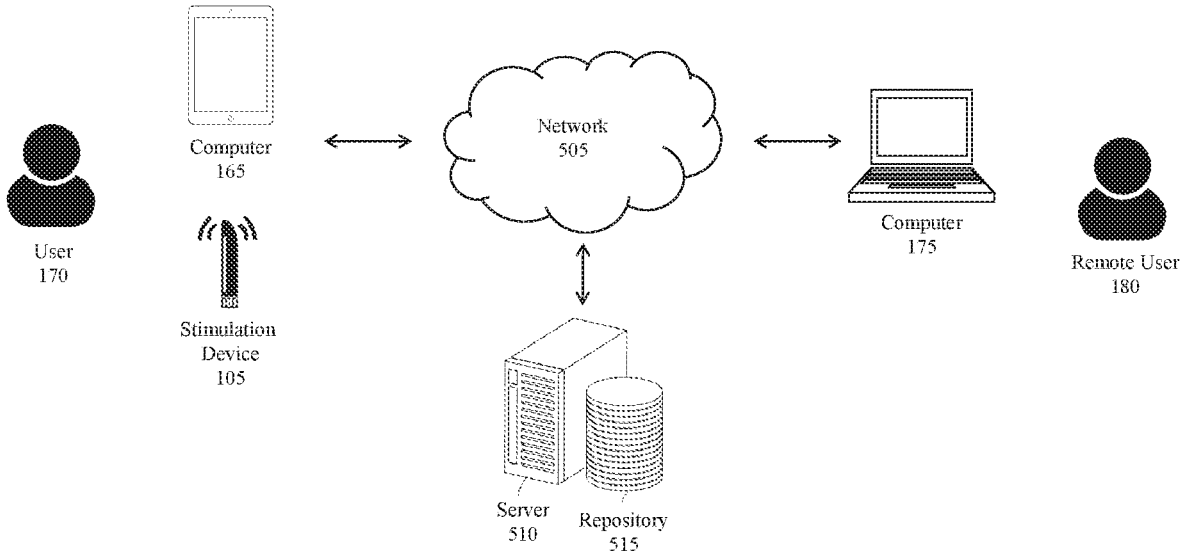
FIG. 5 is a diagram of an operating environment that supports a system for sexual stimulation over a communications network, according to an example embodiment of the present invention.

A processor 160 is housed within the elongated shaped assembly. The processor is configured for receiving, from a remote computing device of a user a first signal for controlling at least one of sound and vibrations to emanate from the speaker, light to emanate from the at least one light emitting element and heat to emanate from the heating element, and sending at least one second signal to cause at least one of sound and vibrations to emanate from the speaker, light to emanate from the at least one light emitting element, and heat to emit from the heating element. For clarity, the elongated shaped assembly can function without a remote computing device. As best shown in FIG. 5, in one embodiment, a user 170 utilizes a remote computing device 165 to control the functions of the elongated shaped assembly for self-stimulation. In certain embodiments, a kit including a remote computing device and the elongated assembly may be provided to the user for providing sexual stimulation to the user. The user may control how the various components of the elongated shaped assembly are performed. For example, the user may select the temperature of the heating element, adjust the light color, color-change sequence, color selection, and color-change transition effects of the at least one light emitting element, regulate the speed and motion of the vibrating element, and sync the sound channels and vibrations emanating from the speaker to music. In another embodiment, the user is stimulated by a remote user 180 utilizing a remote computing device 175 to control the functions of the elongated shaped assembly. The remote user may control how the various components of the elongated shaped assembly are to be imparted on the user. For example, the remote user may select the temperature of the heating element, adjust the light color, color-change sequence, color selection, and color-change transition effects of the at least one light emitting element, regulate the speed and motion of the vibrating element, and sync the sound channels and vibrations emanating from the speaker to music.

FIG. 5 is a diagram of an operating environment that supports a system for sexual stimulation over a communications network, according to an example embodiment of the present invention. The system includes a communications network 505. The communications network may include one or more packet switched networks, such as the Internet, or any local area networks, wide area networks, enterprise private networks, cellular networks, phone networks, mobile communications networks, or any combination of the above. In the present embodiment, the communications network is a cellular network.

A server 510 is communicatively coupled with the communications network. The server includes a software engine that delivers applications, data, program code and other information to networked devices 105, 165, 175. The software engine of server may perform other processes such as audio and/or video streaming or other standards for transferring multimedia data in a stream of packets that are interpreted and rendered by a software application as the packets arrive.

The server includes a database 515, which may be a relational database comprising a Structured Query Language (SQL) database stored in a SQL server or a database that adheres to the NoSQL paradigm. The database may serve sensor data, as well as related information, used by server and networked devices 105, 165, 175 during the course of operation of the invention.

Networked devices 105, 165, 175 are connected to the communications network. The networked devices device may comprise any computing device, such as integrated circuits, printed circuit boards, processors, ASICs, PCBs, cellular telephones, smart phones, tablet computers, laptops, and game consoles, for example. Remote computing device may be connected either wirelessly or in a wired or fiber optic form to the communications network.

Figure 6:
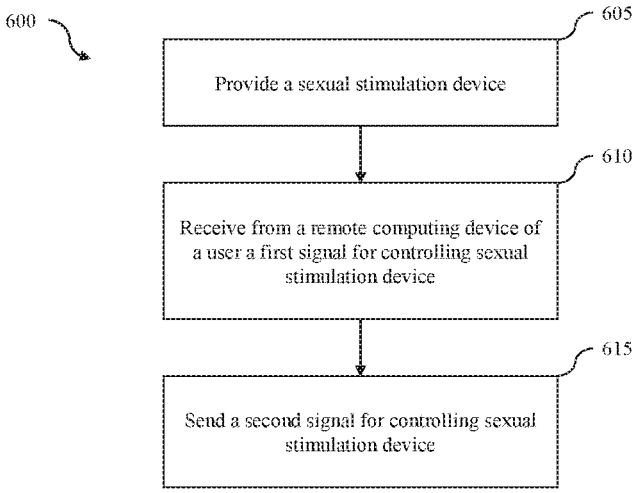
FIG. 6 is a flowchart describing the steps of the process performed by the system, according to an example embodiment of the present invention.

FIG. 6 is a flowchart describing the steps of the process 600 performed by the system, according to an example embodiment of the present invention. The sequence of steps depicted is for illustrative purposes only and is not meant to limit the method in any way as it is understood that the steps may proceed in a different logical order, additional or intervening steps may be included, or described steps may be divided into multiple steps, without detracting from the invention. First, in step 605, the process includes providing a sexual stimulation device. As described above with respect to FIGS. 1-4, the sexual stimulation device includes an elongated shaped assembly 105 defining a shaft 110 having forward end 111, a rearward end 112, an upward facing side 113 and a downward facing side 114. In one embodiment, the forward end of the elongated shaped assembly has a rounded dome-like shape, and the rearward end of the of the elongated shaped assembly has a substantially planar surface. The upward facing side and the downward facing side of the elongated shaped assembly extend upwardly from the rearward end to the forward end of the elongated shaped assembly, defining the cylindrical shape of the shaft. The elongated shaped assembly further includes an internal cavity which is cylindrical, preferably of circular cross-section. The elongated shaped assembly is covered by a silicone 115 defining a penis shape 120. The silicone is configured to provide one continuous skin-like surface that is smooth and soft. In one embodiment, the silicone consists of a hollow cylindrical shaped body having the form of an erect penis and is configured to be slid over the forward end of the elongated shaped assembly. The silicone contains a plurality of openings 121 to allow at least one light emitting element and user interface located on the elongated shaped assembly to remain uncovered and therefore functional. A heating element 125 is attached with the upward facing side on the forward end of the elongated shaped assembly. The heating element provides a warming effect along the body of the elongated shaped assembly to increase blood flow, circulation, and sensitivity in the genital area. In one embodiment, the heating element is positioned inside a groove 130 along an outward facing surface of the elongated shaped assembly 131 such that an outward facing surface of heating element 132 is flush with the outward facing surface of the elongated shaped assembly. At least one light emitting element 135 is attached with the elongated shaped assembly and configured to emit light from the elongated shaped assembly. In one embodiment, the at least one light emitting element is conductively and communicatively coupled with the central processing unit and power source and configured such that light is emitted from the upward side of the elongated shaped assembly. The at least one light emitting element is configured to light up when the elongated shaped assembly is in use and may also include a timer that would periodically pulse light such that it is easy to find in the dark for retrieval and reuse. A vibrating element 140 is housed by the elongated shaped assembly and configured for providing a vibrating sensation along the body of the elongated shaped assembly. The vibrating element is also configured to provide oscillating, rotating, pulsating, or sweeping motion. A speaker is positioned within the elongated shaped assembly and configured to emit sound and vibration throughout the elongated shaped assembly. In one embodiment, the speakers emit sound from the rearward end of the elongated shaped housing. The speaker is configured to produce various sound channels, for example, low frequency, into corresponding physical vibrations. The physical vibrations from the sound waves stimulate the surface of highly-sensitive erogenous zones and adds a new dimension to a user's sexual experience. A user interface 150 for controlling at least the heating element and the at least one light emitting element is positioned along the elongated shaped assembly. The user interface comprises at least one button 151 that is in electoral communication with the processor. The at least one button can be depressed or pushed a predetermined number of times to control the functionality of the elongated shaped assembly, including the intensity from the heating element, the light color, color-change sequence, color selection, color-change transition effects (fast fade, slow fade, etc.), color-change duration or speed, and flashing or strobe effects of the at least one light emitting element, and the speed and motion of the vibrating element. A charging port 155 is positioned on the rearward end of the elongated shaped assembly. The charging port is configured to connect to a power source 152, such as a long-lasting quick to charge lithium-ion battery, housed within the elongated shaped assembly. A processor 160 is housed within the elongated shaped assembly. The processor is configured for receiving, from a remote computing device of a user a first signal for controlling at least one of sound and vibrations to emanate from the speaker, light to emanate from the at least one light emitting element and heat to emanate from the heating element, and sending at least one second signal to cause at least one of sound and vibrations to emanate from the speaker, light to emanate from the at least one light emitting element, and heat to emit from the heating element.

Next, in step 610, the processor receives from a remote computing device of a user a first signal for controlling at least one of sound and vibrations to emanate from the speaker, light to emanate from the at least one light emitting element, and heat to emanate from the heating element. As described above with respect to FIG. 5, in one embodiment, the processor receives a first signal from a user 170 utilizing a remote computing device 165 to control the functions of the elongated shaped assembly for self-stimulation. The user may control how the various components of the elongated shaped assembly are performed. For example, the user may select the temperature of the heating element, adjust the light color, color-change sequence, color selection, and color-change transition effects of the at least one light emitting element, regulate the speed and motion of the vibrating element, and sync the sound channels and vibrations emanating from the speaker to music. In another embodiment, the processor receives a first signal from a remote user 180 utilizing a remote computing device 175 to control the functions of the elongated shaped assembly to stimulate the user. The remote user may control how the various components of the elongated shaped assembly are to be imparted on the user. For example, the remote user may select the temperature of the heating element, adjust the light color and color-change transition effects of the at least one light emitting element, regulate the speed and motion of the vibrating element, and sync the sound channels and vibrations emanating from the speaker to music.

In step 615, the processor sends a second signal to cause least one of sound and vibrations to emanate from the speaker, light to emanate from the at least one light emitting element, and heat to emit from the heating element. For example, the second signal may cause the temperature of the heating element to rise, the color selection of the at least one light emitting element to change, the speed of the vibrating element to increase, and the sound and vibration emanating from the speaker to music to decrease.

Figure 7:
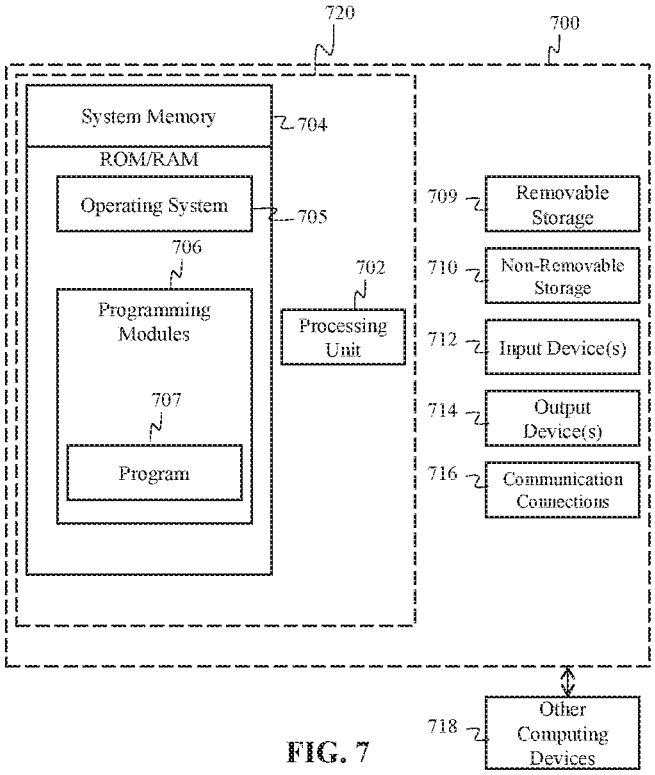
FIG. 7 is a block diagram of a system including an example computing device and other computing devices, according to an example embodiment of the present invention.

FIG. 7 is a block diagram of a system including an example computing device 700 and other computing devices. Consistent with the embodiments described herein, the aforementioned actions may be implemented in a computing device, such as the computing device of FIG. 7. Any suitable combination of hardware, software, or firmware may be used to implement the computing device. The aforementioned system, device, and processors are examples and other systems, devices, and processors may comprise the aforementioned computing device.

With reference to FIG. 7, a system consistent with an embodiment of the invention may include a plurality of computing devices, such as computing device 700. In a basic configuration, computing device may include at least one processing unit 702 and a system memory 704. Depending on the configuration and type of computing device, system memory 704 may comprise, but is not limited to volatile (e.g. random-access memory (RAM)), non-volatile (e.g. read-only memory (ROM)), flash memory, or any combination or memory. System memory 704 may also include operating system 705, and one or more programming modules 706 (such as program module 707). Operating system 705, for example, may be suitable for controlling the operation of computing device 700. In one embodiment, programming modules 706 may include, for example, a program module 707. Furthermore, embodiments of the invention may be practiced in conjunction with a graphics library, other operating systems, or any other application program and is not limited to any particular application or system. This basic configuration is illustrated in FIG. 7 by those components within a dashed line 720.

Computing device 700 may have additional features or functionality. For example, computing device 700 may also include additional data storage devices (removable and/or non-removable) such as, for example, magnetic disks, optical disks, or tape. Such additional storage is illustrated in FIG. 7 by a removable storage 709 and a non-removable storage 710. Computer storage media may include volatile and nonvolatile, removable and non-removable media implemented in any method or technology for storage of information, such as computer readable instructions, data structures, program modules, or other data. System memory 704, removable storage 709, and non-removable storage 710 are all computer storage media examples (i.e., memory storage). Computer storage media may include, but is not limited to, RAM ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 700. Any such computer storage media may be part of computing device 700. Computing device 700 may also have input device(s) 712 such as a keyboard, a mouse, a pen, a sound input device, a camera, a touch input device, etc. Output device(s) 714 such as a display, audio speakers, or printer, may also be included. The aforementioned devices are only examples, and other devices may be added or substituted.

Computing device 700 may also contain a communication connection 716 that may allow computing device 700 to communicate with other computing devices 718, such as over a network in a distributed computing environment, for example, an intranet or the Internet. Communication connection 716 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media, such as a wired network or direct-wired connection, and wireless media, such as acoustic, radio frequency (RF), infrared, and other wireless media. The term computer readable media as used herein may include both, computer storage media and communication media.

As stated above, a number of program modules and data files may be stored in system memory 704, including operating system 705. While executing on processing unit 702, programming modules 706 may perform processes including, for example, one or more of the methods shown in FIG. 6. Computing device 700 may also include a graphics processing unit, which supplements the processing capabilities of processor 702 and which may execute programming modules 706, including all or a portion of those processes and methods shown in FIG. 6. The aforementioned processes are examples, and processing unit 702 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general-purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A system for sexual stimulation comprising:

an elongated shaped assembly defining a shaft having forward end, a rearward end, an upward facing side and a downward facing side;

a heating element in attached with the upward facing side on the forward end of the elongated shaped assembly;

at least one light emitting element in attached with the elongated shaped assembly and configured to emit light from the elongated shaped assembly;

a vibrating element housed by the elongated shaped assembly and configured for providing a vibrating sensation along the body of the elongated shaped assembly;

a speaker positioned within the elongated shaped assembly and configured to emit sound and vibration the elongated shaped assembly;

a user interface for controlling at least the heating element and the at least one light emitting element;

a charging port positioned on the rearward end of the elongated shaped assembly;

a processor housed within the elongated shaped assembly, wherein the processor is configured for:

receiving, from a remote computing device of a user, a first signal for controlling at least one of sound and vibrations to emanate from the speaker, light to emanate from the at least one light emitting element, and heat to emanate from the heating element; and, sending at least one second signal to cause at least one of sound and vibrations to emanate from the speaker, light to emanate from the at least one light emitting element, and heat to emit from the heating element.

2. The system for sexual stimulation of claim 1, wherein the lights are configured such that light is emitted from the upward side of the elongated shaped assembly.

3. The system for sexual stimulation of claim 1, wherein the heating element is positioned inside a groove along an outward facing surface of the elongated shaped assembly such that an outward facing surface of heating element is flush with the outward facing surface of the elongated shaped assembly.

4. The system for sexual stimulation of claim 1, wherein elongated shaped assembly is covered by a silicone defining a penis shape.

5. The system for sexual stimulation of claim 1, wherein the user interface comprises at least one button that is in electoral communication with the processor.

6. The system for sexual stimulation of claim 1, wherein the speakers emit sound from the rearward end of the elongated shaped housing.

7. A kit for sexual stimulation comprising:

a remote computing device;

an elongated shaped assembly comprising, a shaft having forward end, a rearward end, an upward facing side and a downward facing side;

a heating element in attached with the upward facing side on the forward end of the elongated shaped assembly;

at least one light emitting element in attached with the elongated shaped assembly and configured to emit light from the elongated shaped assembly;

a vibrating element housed by the elongated shaped assembly and configured for providing a vibrating sensation along the body of the elongated shaped assembly;

a speaker positioned within the elongated shaped assembly and configured to emit sound and vibration the elongated shaped assembly;

a charging port positioned on the rearward end of the elongated shaped assembly;

a processor housed within the elongated shaped assembly, wherein the processor is configured for, receiving, from the remote computing device, a first signal for controlling at least one of sound and vibrations to emanate from the speaker, light to emanate from the at least one light emitting element and heat to emanate from the heating element; and, sending at least one second signal to cause at least one of sound and vibrations to emanate from the speaker, light to emanate from the at least one light emitting element, and heat to emit from the heating element.

8. The kit for sexual stimulation of claim 7, wherein the lights are configured such that light is emitted from the upward side of the elongated shaped assembly.

9. The kit for sexual stimulation of claim 8, wherein the heating element is positioned inside a groove along an outward facing surface of the elongated shaped assembly such that an outward facing surface of heating element is flush with the outward facing surface of the elongated shaped assembly.

10. The kit for sexual stimulation of claim 9, wherein elongated shaped assembly is covered by a silicone defining a penis shape.

11. The kit for sexual stimulation of claim 10, wherein the user interface comprises at least one button that is in electoral communication with the processor.

12. The kit for sexual stimulation of claim 11, wherein the speakers emit sound from the rearward end of the elongated shaped housing.

13. A method for sexual stimulation comprising:

a) providing a device comprising, an elongated shaped assembly defining a shaft having forward end, a rearward end, an upward facing side and a downward facing side;

a heating element in attached with the upward facing side on the forward end of the elongated shaped assembly;

at least one light emitting element in attached with the elongated shaped assembly and configured to emit light from the elongated shaped assembly;

a vibrating element housed by the elongated shaped assembly and configured for providing a vibrating sensation along the body of the elongated shaped assembly;

a speaker positioned within the elongated shaped assembly and configured to emit sound and vibration the elongated shaped assembly;

a user interface for controlling at least the heating element and the at least one light emitting element;

a charging port positioned on the rearward end of the elongated shaped assembly;

a processor housed within the elongated shaped assembly, wherein the processor is configured for:

receiving, from a remote computing device of a user, a first signal for controlling at least one of sound and vibrations to emanate from the speaker, light to emanate from the at least one light emitting element, and heat to emanate from the heating element; and, sending at least one second signal to cause at least one of sound and vibrations to emanate from the speaker, light to emanate from the at least one light emitting element and heat to emit from the heating element;

b) receiving, from the remote computing device of the user, the first signal; and, c) sending the second signal to cause least one of sound and vibrations to emanate from the speaker, light to emanate from the at least one light emitting element, and heat to emit from the heating element.

14. The method of claim 13, wherein the lights are configured such that light is emitted from the upward side of the elongated shaped assembly.

15. The method of claim 13, wherein the heating element is positioned inside a groove along an outward facing surface of the elongated shaped assembly such that an outward facing surface of heating element is flush with the outward facing surface of the elongated shaped assembly.

16. The method of claim 13, wherein elongated shaped assembly is covered by a silicone defining a penis shape.

17. The method of claim 13, wherein the user interface comprises at least one button that is in electoral communication with the processor.

18. The method of claim 13, wherein the speakers emit sound from the rearward end of the elongated shaped housing.

* * * * *